US011038276B2

(12) United States Patent
Park et al.

(10) Patent No.: US 11,038,276 B2
(45) Date of Patent: Jun. 15, 2021

(54) SUBSTRATE-INTEGRATED WAVEGUIDE SLOT ANTENNA WITH METASURFACE

(71) Applicant: AJOU UNIVERSITY INDUSTRY-ACADEMIC COOPERATION FOUNDATION, Suwon-si (KR)

(72) Inventors: Yong Bae Park, Seoul (KR); Hyung Jun An, Yongin-si (KR); Chang Seong Kim, Suwon-si (KR)

(73) Assignee: AJOU UNIVERSITY INDUSTRY-ACADEMIC COOPERATION FOUNDATION, Suwon-si (KR)

( * ) Notice: Subject to any disclaimer, the term of this patent is extended or adjusted under 35 U.S.C. 154(b) by 0 days.

(21) Appl. No.: 16/817,954

(22) Filed: Mar. 13, 2020

(65) Prior Publication Data

US 2020/0373678 A1 Nov. 26, 2020

(30) Foreign Application Priority Data

May 20, 2019 (KR) ..... 10-2019-0058699

(51) Int. Cl.

| | |
|---|---|
| ***H01Q 13/10*** | (2006.01) |
| ***H01P 3/12*** | (2006.01) |
| ***H01Q 15/00*** | (2006.01) |
| ***H01Q 21/00*** | (2006.01) |

(52) U.S. Cl.

CPC ..... *H01Q 13/10* (2013.01); *H01P 3/121* (2013.01); *H01Q 15/0086* (2013.01); *H01Q 21/0043* (2013.01)

(58) Field of Classification Search

CPC ..... H01Q 13/10–28; H01Q 15/0086; H01P 3/121

See application file for complete search history.

(56) References Cited

U.S. PATENT DOCUMENTS

2019/0326684 A1* 10/2019 Achour ..... G01S 13/02
2019/0379132 A1* 12/2019 Pelletti ..... H01Q 21/065

FOREIGN PATENT DOCUMENTS

KR 10-2001-0054058 A 7/2001
KR 2001-0054058 A 7/2001
KR 10-2010-0118889 A 11/2010

OTHER PUBLICATIONS

Communication dated Jul. 18, 2019, issued by the Korean Patent Office in counterpart Korean Patent Application No. 10-2019-0058699.

* cited by examiner

*Primary Examiner* — Dimary S Lopez Cruz
*Assistant Examiner* — Amal Patel
(74) *Attorney, Agent, or Firm* — Sughrue Mion, PLLC

(57) ABSTRACT

Disclosed is a substrate-integrated waveguide slot antenna including a lower substrate having a substrate-integrated waveguide structure, the lower substrate being provided in the upper surface thereof with at least one slot, whereby an electromagnetic wave is guided by the substrate-integrated waveguide structure and is emitted through the slot, and an upper substrate formed on the lower substrate, the upper substrate having a metasurface configured such that a plurality of unit cells is arranged at predetermined intervals, whereby the electromagnetic wave dispatched through the slot is reemitted by the metasurface.

8 Claims, 8 Drawing Sheets
(2 of 8 Drawing Sheet(s) Filed in Color)

SIW~Substrate Integrated Waveguide

SUBSTRATE-INTEGRATED WAVEGUIDE SLOT ANTENNA WITH METASURFACE

CROSS-REFERENCE TO RELATED APPLICATION

This application claims the priority benefit of Korean Patent Application No. 10-2019-0058699, filed on May 20, 2019 in the Korean Intellectual Property Office, the disclosure of which is incorporated herein by reference.

BACKGROUND OF THE INVENTION

1. Field of the Invention

The present invention relates to a substrate-integrated waveguide slot antenna, and more particularly to a substrate-integrated waveguide slot antenna including a metasurface, whereby the gain and the bandwidth of the slot antenna are increased.

2. Description of the Related Art

In recent years, a small-sized antenna has been widely used, since the antenna has a small thickness, is easy to integrate, can be manufactured at low cost, and can be manufactured within a short time.

Conventionally, a satellite industry based on medium-sized or large-sized satellites was developed. The medium-sized or large-sized satellite has shortcomings in that the satellite is manufactured at a cost of a minimum of one hundred billion won and during a manufacturing period of 5 years or more, although the manufacturing period and the manufacturing cost vary depending on the size thereof. In space industry technology, a small-sized satellite or a cube satellite have attracted great attention as a satellite that is capable of replacing some of the functions of the conventional medium-sized or large-sized satellite while solving shortcomings of the medium-sized or large-sized satellite in terms of cost and period. In the cube satellite, various kinds of antennas are used depending on purposes, and the size of each antenna is generally limited to $10\times10\times10$ $cm^3$ or less. A patch antenna easily mounted to a hexahedron, which is the shape of the cube satellite, is being widely used. However, the patch antenna has limitation in terms of gain and bandwidth. In other words, the patch antenna has a low gain and a narrow bandwidth.

An antenna having a substrate-integrated waveguide structure may be used as the patch antenna described above. The antenna having the substrate-integrated waveguide structure has advantages in that the antenna is integrated in a substrate, whereby the antenna has a small thickness, can be manufactured based on a miniature design, and has a structure like a waveguide. However, the antenna having the substrate-integrated waveguide structure mainly emits an electromagnetic wave through a slot. Furthermore, the substrate-integrated waveguide slot antenna still has a narrow bandwidth, since the antenna has a high Q factor.

SUMMARY OF THE INVENTION

Therefore, the present invention has been made in view of the above problems, and it is an object of the present invention to provide a substrate-integrated waveguide slot antenna including a metasurface that is capable of overcoming limitations in gain and bandwidth of the antenna having the substrate-integrated waveguide structure described above, i.e. a low gain and a narrow bandwidth of the antenna.

In accordance with an aspect of the present invention, the above and other objects can be accomplished by the provision of a substrate-integrated waveguide slot antenna including a lower substrate having a substrate-integrated waveguide structure, the lower substrate being provided in the upper surface thereof with at least one slot, whereby an electromagnetic wave is guided by the substrate-integrated waveguide structure and is emitted through the slot, and an upper substrate formed on the lower substrate, the upper substrate having a metasurface configured such that a plurality of unit cells is arranged at predetermined intervals, whereby the electromagnetic wave dispatched through the slot is reemitted by the metasurface.

The lower substrate may include a first layer, a second layer located on the first layer, the slot being formed in the second layer, and a plurality of vias, each of the plurality of vias extending in a vertical direction to connect the first layer and the second layer to each other, the plurality of vias being arranged at predetermined intervals to guide an electromagnetic wave.

The lower substrate may further include an introduction portion formed at one side thereof in a direction in which the plurality of vias is arranged to allow an electromagnetic wave to be introduced therethrough.

The metasurface may be configured such that a plurality of metal conductors is arranged while having periods at predetermined intervals, each of the plurality of metal conductors being formed so as to have a predetermined shape.

The metasurface may be configured such that a plurality of quadrangular metal conductors is arranged in a two-dimensional plane at predetermined intervals.

In accordance with another aspect of the present invention, there is provided a substrate-integrated waveguide slot antenna including a lower substrate having a substrate-integrated waveguide structure, the lower substrate being provided in the upper surface thereof with at least one slot, and an upper substrate formed on the lower substrate, the upper substrate having a metasurface configured such that a plurality of unit cells is arranged at predetermined intervals.

An electromagnetic wave introduced into the substrate-integrated waveguide structure may be guided by the substrate-integrated waveguide structure and may be emitted through the slot, and the electromagnetic wave emitted through the slot may be reemitted through the metasurface of the upper substrate.

The lower substrate may include a first layer, a second layer located on the first layer, the slot being formed in the second layer, and a plurality of vias, each of the plurality of vias extending in a vertical direction to connect the first layer and the second layer to each other, the plurality of vias being arranged at predetermined intervals to guide an electromagnetic wave.

The lower substrate may further include an introduction portion formed at one side thereof in a direction in which the plurality of vias is arranged to allow an electromagnetic wave to be introduced therethrough.

The metasurface may be configured such that a plurality of metal conductors is arranged in a two-dimensional plane at predetermined intervals, each of the plurality of metal conductors being formed so as to have a predetermined shape.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The above and other objects, features and other advantages of the present invention will be more clearly understood from the following detailed description taken in conjunction with the accompanying drawings, in which.

DETAILED DESCRIPTION OF THE PREFERRED EMBODIMENTS

It should be noted that terms or words used in this specification and the claims are not to be interpreted as having ordinary and dictionary-based meanings but as having meanings and concepts coinciding with the technical idea of the present invention based on the principle that the inventors may properly define the concepts of the terms in order to explain the invention in the best way.

In the case in which a part "includes" a component, throughout this specification, this means that the part may not exclude another component but may further include another component unless otherwise mentioned. In addition, the term "unit," "part," "module," or "device" used herein signifies one unit that processes at least one function or operation, and may be realized by hardware, software, or a combination thereof.

Hereinafter, embodiments of the present invention will be described in detail with reference to the accompanying drawings.

Figure 1:
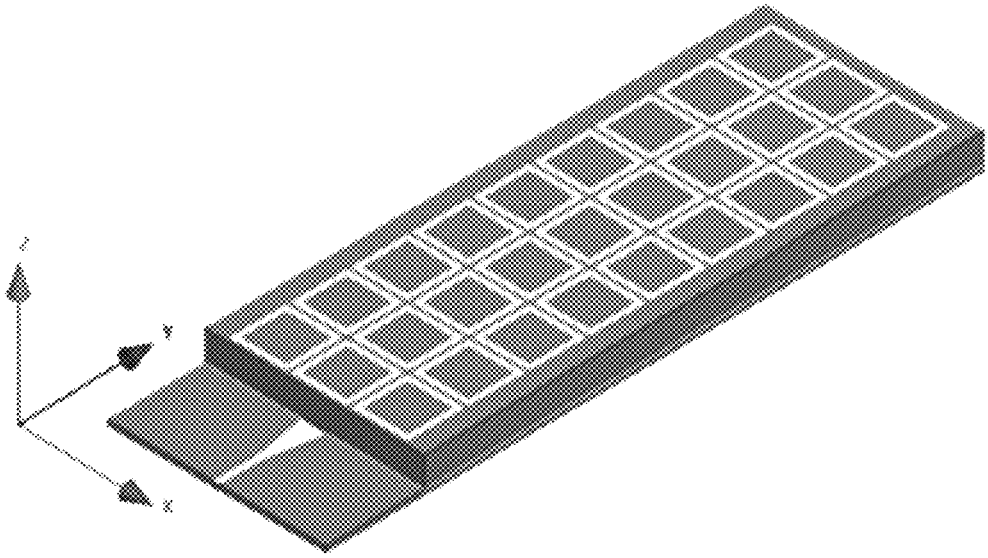
FIG. 1 is a perspective view of a slot antenna having a substrate-integrated waveguide structure according to an embodiment of the present invention.
Figure 2:
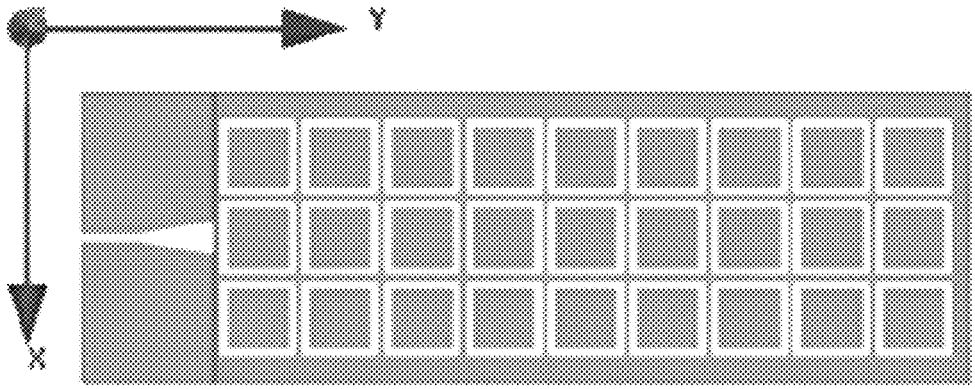
FIG. 2 is a top view of the slot antenna having the substrate-integrated waveguide structure according to the embodiment of the present invention.
Figure 3:
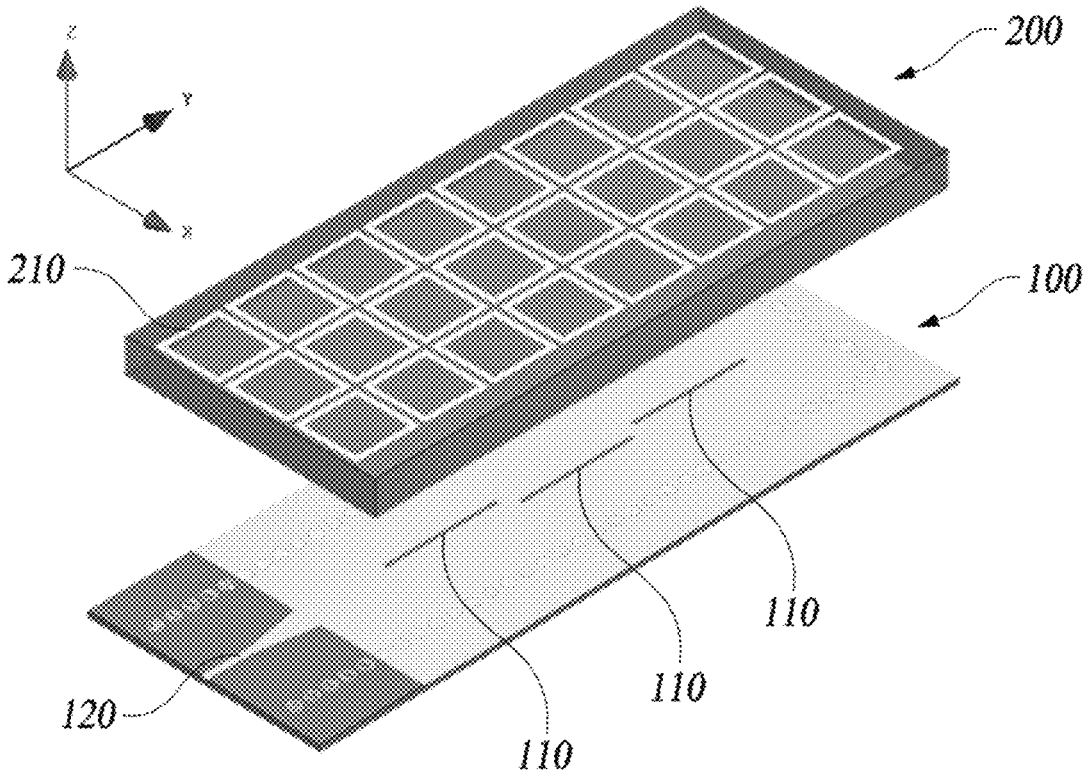
FIG. 3 is an exploded perspective view of the slot antenna having the substrate-integrated waveguide structure according to the embodiment of the present invention.

FIG. 1 is a perspective view of a slot antenna 1 having a substrate-integrated waveguide structure according to an embodiment of the present invention, FIG. 2 is a top view of the slot antenna 1 having the substrate-integrated waveguide structure according to the embodiment of the present invention, and FIG. 3 is an exploded perspective view of the slot antenna 1 having the substrate-integrated waveguide structure according to the embodiment of the present invention.

Referring to FIGS. 1 to 3, the slot antenna 1 having the substrate-integrated waveguide structure according to the embodiment of the present invention includes a lower substrate 100 having a substrate-integrated waveguide structure, the lower substrate 100 being provided in the upper surface thereof with at least one slot 110, and an upper substrate 200 stacked on the lower substrate 100, the upper substrate 200 having a metasurface configured such that a plurality of unit cells 210 is arranged at predetermined intervals.

Next, the lower substrate 100 of the slot antenna 1 having the substrate-integrated waveguide structure according to the embodiment of the present invention will be described with reference to FIGS. 4 to 6.

Figure 4:
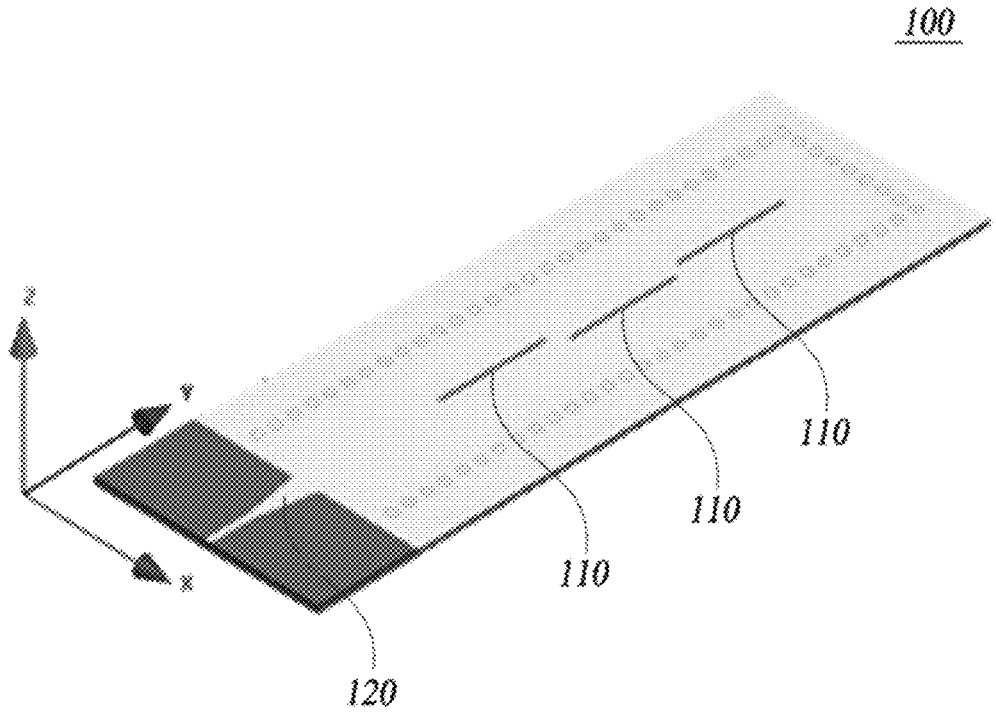
FIG. 4 is a perspective view of a lower substrate of the slot antenna having the substrate-integrated waveguide structure according to the embodiment of the present invention.
Figure 5:
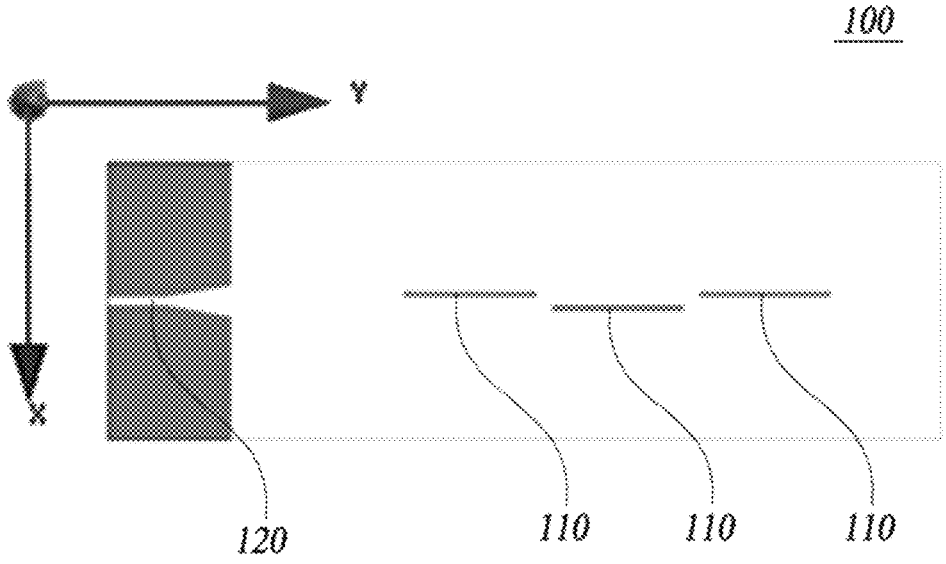
FIG. 5 is a top view of the lower substrate of the slot antenna having the substrate-integrated waveguide structure according to the embodiment of the present invention.

FIG. 4 is a perspective view of the lower substrate 100 of the slot antenna 1 having the substrate-integrated waveguide structure according to the embodiment of the present invention, and FIG. 5 is a top view of the lower substrate 100 of the slot antenna 1 having the substrate-integrated waveguide structure according to the embodiment of the present invention.

As shown in FIGS. 4 and 5, an introduction portion 120 may be formed in the lower substrate 100, and at least one slot 110 may be formed in the upper surface of the lower substrate 100. As a result, an electromagnetic wave dispatched through the introduction portion 120 is guided by the substrate-integrated waveguide structure of the lower substrate 100, and is emitted through the slot 110. The introduction portion 120 may be formed of a microstrip line.

Although three slots 110 are shown in FIGS. 4 and 5, another number of slots may be formed. In addition, although the introduction portion 120 is shown as being formed at one side of the lower substrate 100 in the y-axis direction and the slots 110 are shown as being arranged in the y-axis direction, the position of the introduction portion 120 and the direction in which a plurality of slots 110 is arranged may be changed.

Figure 6:
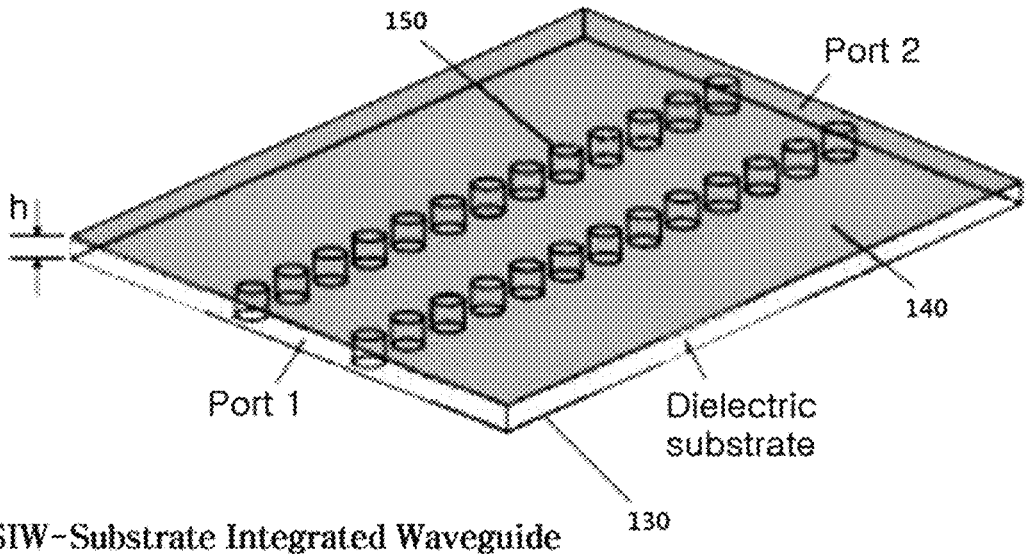
FIG. 6 is a view illustrating a substrate-integrated waveguide structure of the lower substrate of the slot antenna having the substrate-integrated waveguide structure according to the embodiment of the present invention.

FIG. 6 is a view illustrating the substrate-integrated waveguide structure of the lower substrate 100 of the slot antenna 1 having the substrate-integrated waveguide structure according to the embodiment of the present invention, and corresponds to a portion of the lower substrate 100. The slots and the introduction portion are not shown in FIG. 6, and only some of a plurality of vias 150 are shown.

Referring to FIG. 6, the lower substrate 100 may include a first layer 130 formed of metal, a second layer 140 located on the first layer 130, the slots 110 being formed in the second layer 140, and a plurality of vias 150, each of which extends in the vertical direction to connect the first layer 130 and the second layer 140 to each other, the vias 150 being arranged at predetermined intervals to guide an electromagnetic wave. In this embodiment, the first layer 130 and the second layer 140 may be grounded. A gap between the first layer 130 and the second layer 140 may be filled with a dielectric material.

In the lower substrate 100 having the substrate-integrated waveguide structure described above, an electromagnetic wave may be introduced through port 1, may be guided by the plurality of vias, and may be output through port 2.

Referring back to FIG. 4, in the lower substrate 100 of the slot antenna 1 having the substrate-integrated waveguide structure according to this embodiment, the plurality of vias may be arranged in a double line in the y-axis direction, and may be arranged at the y-axis end side in the x-axis direction. That is, as shown in FIG. 4, the plurality of vias may be arranged so as to have the shape of "⊏" and the introduction portion may be connected to an opening having the shape of "⊐". In addition, the slots 110 are formed in the second layer of the lower substrate 100. As a result, an electromagnetic wave may be introduced through the introduction portion 120, may be guided by the plurality of vias, and may be output through the slots 110.

Figure 7:
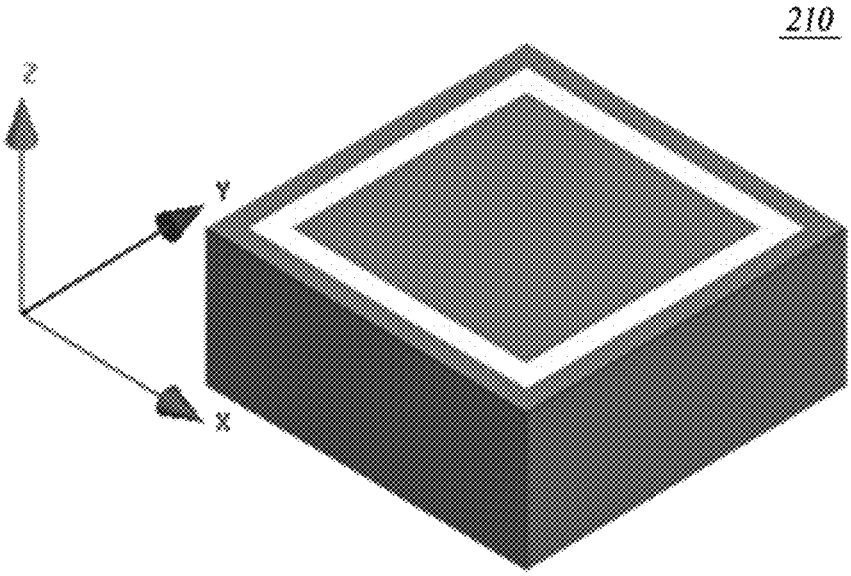
FIG. 7 is a perspective view of a unit cell that forms a metasurface of an upper substrate according to an embodiment of the present invention.
Figure 8:
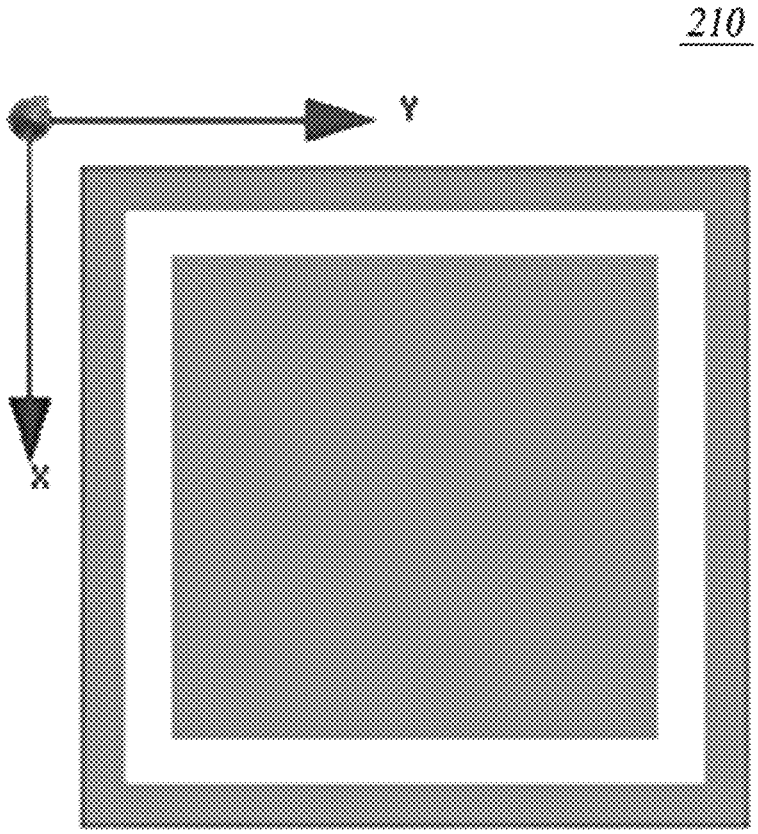
FIG. 8 is a top view of the unit cell that forms the metasurface of the upper substrate according to the embodiment of the present invention.

FIG. 7 is a perspective view of a unit cell 210 that forms the metasurface of the upper substrate 200 according to the embodiment of the present invention, and FIG. 8 is a top view of the unit cell 210 that forms the metasurface of the upper substrate 200 according to the embodiment of the present invention.

Referring to FIGS. 1, 2, 7, and 8, the metasurface of the upper substrate 200 may be formed by arranging a plurality of unit cells 210 in a two-dimensional plane at predetermined intervals. In this embodiment, each unit cell 210 may include a quadrangular conductor. In the figures, the yellow quadrangular frame corresponds to the conductor of the unit cell 210.

A metamaterial exhibits dielectric characteristics that do not exist in the natural world through arrangement of conductors having a periodic structure. Since the metamaterial exhibits a refractive index approximate to 0 and various dispersion properties, it is possible to increase the bandwidth and gain of an antenna in the case in which the metamaterial is used as a cover. In this embodiment, the upper substrate 200 having the metasurface is stacked on the lower substrate 100, whereby it is possible to overcome limitations in the gain and bandwidth of the slot antenna 1 having the substrate-integrated waveguide structure.

Figure 9:
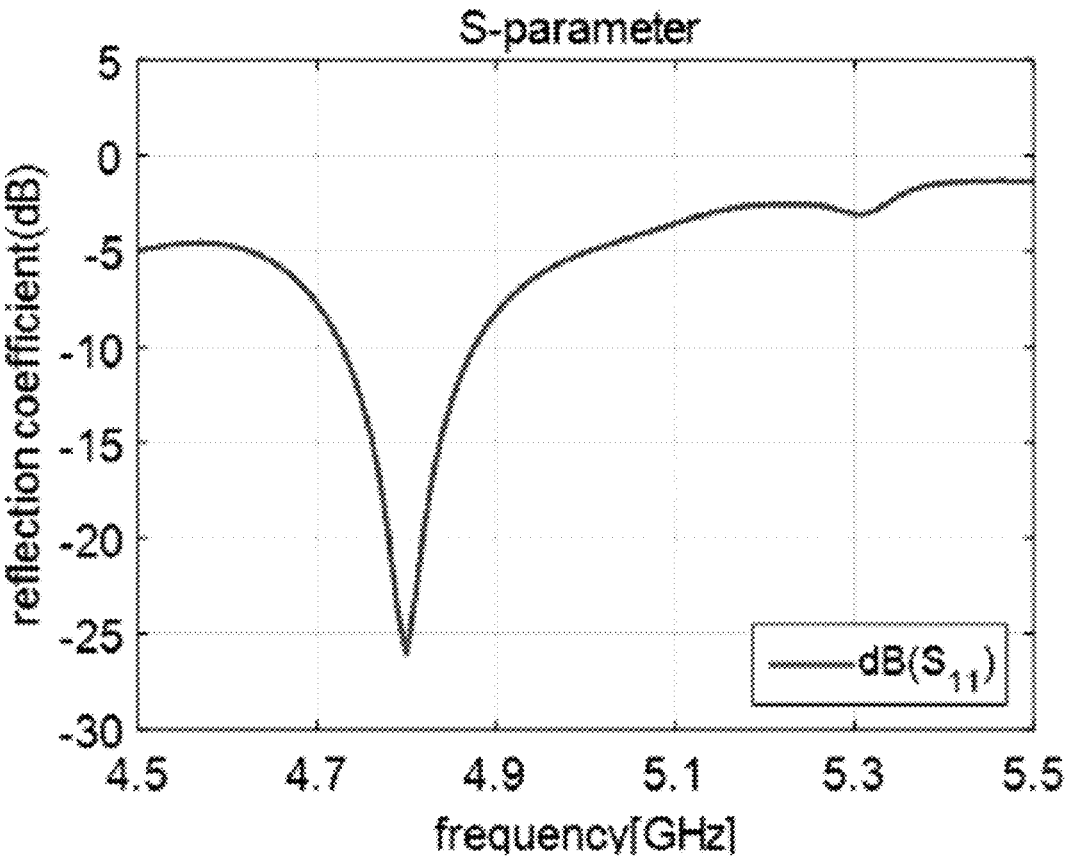
FIG. 9 is a view showing an S parameter of the slot antenna having the substrate-integrated waveguide structure according to the embodiment of the present invention.
Figure 10:
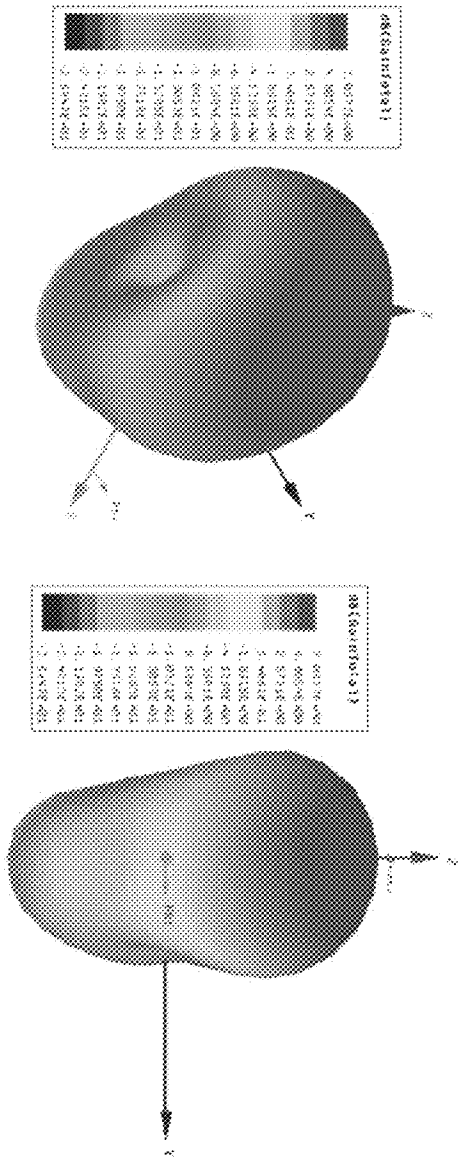
FIG. 10 is a view showing a gain of the slot antenna having the substrate-integrated waveguide structure according to the embodiment of the present invention.
Figure 11:
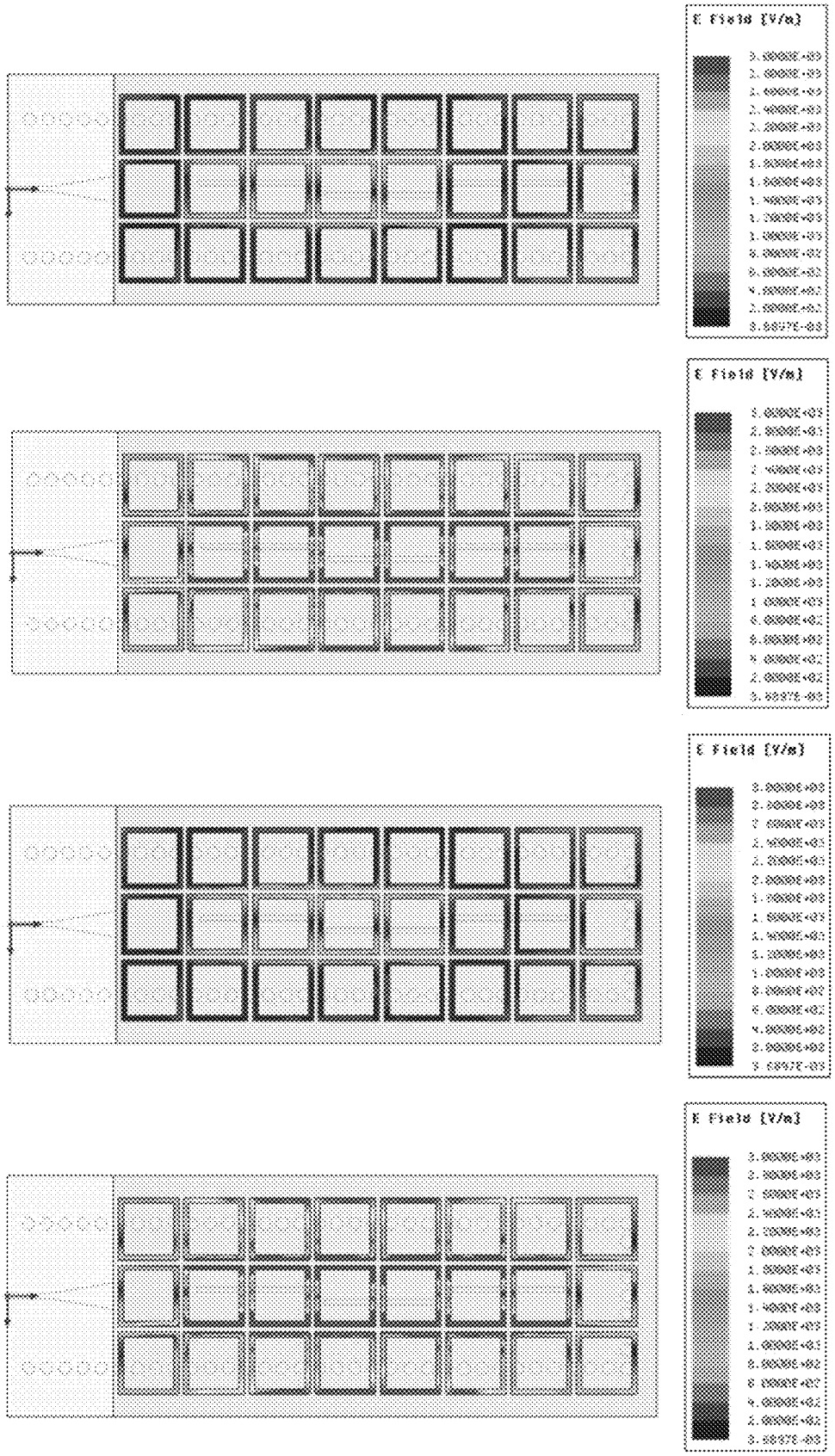
FIG. 11 is a view showing the distribution of an electric field of the slot antenna having the substrate-integrated waveguide structure according to the embodiment of the present invention.

FIGS. 9 to 11 are views showing the results of simulation of the slot antenna having the substrate-integrated waveguide structure according to the embodiment of the present invention.

FIG. 9 is a view showing an S parameter of the slot antenna having the substrate-integrated waveguide structure according to the embodiment of the present invention. An operating frequency is about 4.8 GHz, and it can be seen that the bandwidth of the slot antenna was increased.

FIG. 10 is a view showing a gain of the slot antenna having the substrate-integrated waveguide structure according to the embodiment of the present invention. As can be seen from FIG. 10, the slot antenna having the substrate-integrated waveguide structure according to the embodiment of the present invention has a high gain in the z-axis direction.

FIG. 11 is a view showing the distribution of an electric field of the slot antenna having the substrate-integrated waveguide structure according to the embodiment of the present invention. The distribution of the electric field of the slot antenna at angles of 0°, 90°, 180°, and 270° is shown sequentially from top to bottom of the figure.

As is apparent from the above description, according to the embodiment of the present invention described above, the slot antenna includes a lower substrate having a substrate-integrated waveguide structure and an upper substrate having a metasurface, whereby the bandwidth and the gain of the slot antenna are increased.

Although the present invention has been described in detail based on preferred embodiments, those skilled in the art will appreciate that the present invention is not limited thereto and that various modifications, additions, and substitutions are possible without departing from the scope and spirit of the invention as disclosed in the accompanying claims. Consequently, the true technical protection scope of the present invention should be interpreted by the following claims, and all technical concepts included in a range equivalent thereto should be interpreted as falling within the scope of right of the present invention.

The antenna having the substrate-integrated waveguide structure according to the embodiment of the present invention is applicable not only to satellites but also to fields other than satellites, such as wireless communication.

What is claimed is:

1. A substrate-integrated waveguide slot antenna comprising:

a lower substrate having a substrate-integrated waveguide structure, the lower substrate having a plurality of slots provided in an upper surface of the lower substrate, whereby an electromagnetic wave is guided by the substrate-integrated waveguide structure and is emitted through the plurality of slots; and an upper substrate formed on the lower substrate, the upper substrate having a metasurface configured such that a plurality of unit cells are arranged at predetermined intervals, whereby the electromagnetic wave dispatched through the plurality of slots is reemitted by the metasurface, wherein the lower substrate comprises:

a first layer extending in a first direction and a second direction perpendicular to the first direction;

a second layer located on the first layer and extending in the first direction and the second direction, the plurality of slots being formed in the second layer; and a plurality of vias, each of the plurality of vias extending in a vertical direction to connect the first layer and the second layer to each other, the plurality of vias being arranged at predetermined intervals to guide an electromagnetic wave, the vertical direction being perpendicular to the first direction and the second direction, wherein the plurality of unit cells of the upper substrate include first unit cells arranged in the second direction, center unit cells arranged in the second direction, and second unit cells arranged in the second direction, and the center unit cells being disposed between the first unit cells and the second unit cells and arranged along a center line of the second layer, wherein the plurality of vias include first vias corresponding to the first unit cells and disposed below the first unit cells and arranged in the second direction, and second vias corresponding to the second unit cells and disposed below the second unit cells and arranged in the second direction, wherein the plurality of slots are disposed below only the center unit cells among the plurality of unit cells and arranged in the second direction and parallel to the center line of the second layer, wherein each of the plurality of slots extends in the second direction and is offset from the center line of the second layer, and wherein two adjacent slots among the plurality of slots are offset in opposite directions with respect to the center line of the second layer.

2. The substrate-integrated waveguide slot antenna according to claim 1, wherein the lower substrate further comprises an introduction portion formed at one side of the lower substrate in the second direction in which the plurality of vias are arranged to allow an electromagnetic wave to be introduced therethrough.

3. The substrate-integrated waveguide slot antenna according to claim 1, wherein the metasurface is configured such that a plurality of metal conductors are arranged while having periods at predetermined intervals, each of the plurality of metal conductors being formed so as to have a predetermined shape.

4. The substrate-integrated waveguide slot antenna according to claim 3, wherein the metasurface is configured such that a plurality of quadrangular metal conductors are arranged in a two-dimensional plane at predetermined intervals.

5. A substrate-integrated waveguide slot antenna comprising:

a lower substrate having a substrate-integrated waveguide structure, the lower substrate having a plurality of slots provided in an upper surface of the lower substrate; and an upper substrate formed on the lower substrate, the upper substrate having a metasurface configured such that a plurality of unit cells are arranged at predetermined intervals, wherein the lower substrate comprises:

a first layer extending in a first direction and a second direction perpendicular to the first direction;

a second layer located on the first layer and extending in the first direction and the second direction, the plurality of slots being formed in the second layer; and a plurality of vias, each of the plurality of vias extending in a vertical direction to connect the first layer and the second layer to each other, the plurality of vias being arranged at predetermined intervals to guide an electromagnetic wave, the vertical direction being perpendicular to the first direction and the second direction, wherein the plurality of unit cells of the upper substrate include first unit cells arranged in the second direction, center unit cells arranged in the second direction, and second unit cells arranged in the second direction, and the center unit cells being disposed between the first unit cells and the second unit cells and arranged along a center line of the second layer, wherein the plurality of vias include first vias corresponding to the first unit cells and disposed below the first unit cells and arranged in the second direction, and second vias corresponding to the second unit cells and disposed below the second unit cells and arranged in the second direction, wherein the plurality of slots are disposed below only the center unit cells among the plurality of unit cells and arranged in the second direction and parallel to the center line of the second layer, wherein each of the plurality of slots extends in the second direction and is offset from the center line of the second layer, and wherein two adjacent slots among the plurality of slots are offset in opposite directions with respect to the center line of the second layer.

6. The substrate-integrated waveguide slot antenna according to claim 5, wherein an electromagnetic wave introduced into the substrate-integrated waveguide structure is guided by the substrate-integrated waveguide structure and is emitted through the plurality of slots, and the electromagnetic wave emitted through the plurality of slots is reemitted through the metasurface of the upper substrate.

7. The substrate-integrated waveguide slot antenna according to claim 5, wherein the lower substrate further comprises an introduction portion formed at one side of the lower substrate in a direction in which the plurality of vias are arranged to allow an electromagnetic wave to be introduced therethrough.

8. The substrate-integrated waveguide slot antenna according to claim 5, wherein the metasurface is configured such that a plurality of metal conductors are arranged in a two-dimensional plane at predetermined intervals, each of the plurality of metal conductors being formed so as to have a predetermined shape.

* * * * *